US006962110B2

(12) United States Patent
Hellmeier et al.

(10) Patent No.: US 6,962,110 B2
(45) Date of Patent: Nov. 8, 2005

(54) APPARATUS FOR DECORATING STIFF OBJECTS

(75) Inventors: Joachim Hellmeier, Rödinghausen (DE); Ralf-Rudi Redeker, Bielefeld (DE); Mathias Schulz, Bünde (DE)

(73) Assignee: Werner Kammann Maschinenfabrik GmbH, Bunde (DE)

( * ) Notice: Subject to any disclaimer, the term of this patent is extended or adjusted under 35 U.S.C. 154(b) by 0 days.

(21) Appl. No.: 10/851,005

(22) Filed: May 21, 2004

(65) Prior Publication Data

US 2005/0087082 A1 Apr. 28, 2005

(30) Foreign Application Priority Data

Oct. 22, 2003 (DE) ..... 103 49 560

(51) Int. Cl.[7] ..... B41F 17/08; B41F 15/12

(52) U.S. Cl. ..... 101/44; 101/126; 101/35; 101/38.1

(58) Field of Search ..... 101/35, 41, 44, 101/38.1, 39, 40, 40.1, 115, 126, 129, 424.1, 487, 488

(56) References Cited

U.S. PATENT DOCUMENTS 3,518,939 A * 7/1970 Donner et al. ..... 101/40
6,079,326 A 6/2000 Strutz et al. ..... 101/40
6,546,859 B1 * 4/2003 Troncon et al. ..... 101/126

OTHER PUBLICATIONS

European Search Report for corresponding EPO Application No. 04020367.1 mailed Jan. 13, 2005 (3 pgs).

* cited by examiner

*Primary Examiner*—Leslie J. Evanisko
(74) *Attorney, Agent, or Firm*—Grossman, Tucker, Perreault & Pfleger, PLLC

(57) ABSTRACT

In an apparatus for decorating stiff objects, the objects are transported stepwise along an arcuate conveyor path. Printing stations and drying stations are arranged alternately along the conveyor path with the printing stations at a level above the conveyor path and the drying stations at a level below the conveyor path. Holders for the objects are reciprocatable upwardly and downwardly to permit vertical movements of the objects during the printing operation and/or for setting the objects in different heightwise positions in different stations. The holders for the objects are subdivided into first and second groups, wherein the holders of each group are adjustable in respect of height independently of the holders of the respective other group. The printing stations are screened from view in relation to the drying stations by screening members.

18 Claims, 8 Drawing Sheets

APPARATUS FOR DECORATING STIFF OBJECTS

CROSS-REFERENCES TO RELATED APPLICATIONS

This application claims the priority of German patent application Serial No 103 49 560.6 filed Oct. 22, 2003, the subject matter of which is incorporated herein by reference.

FIELD OF THE INVENTION

The invention concerns an apparatus for decorating objects which are stiff in respect of shape, referred to herein for brevity as stiff objects.

Those objects may be for example bottles comprising glass, plastic material or any other suitable material, or other stiff objects.

BACKGROUND OF THE INVENTION

A form of apparatus for decorating stiff objects, which can be considered representative in this respect, comprises a conveyor path, with holders displaceable along the conveyor path for moving the objects therealong. A plurality of treatment stations for treating the objects are disposed along the conveyor path, including at least one printing station for applying decoration to the articles and at least one drying station downstream of the printing station for drying ink applied to the objects. In that respect it is nowadays the usual practice to employ printing inks which dry comparatively quickly, for example under the effect of UV radiation.

In the case of multi-color printing the procedure adopted is frequently such that partial print images involving different colors are applied to the object in successive printing steps, for example using a screen printing process. The totality of those partial print images which are printed one within the other then affords the overall print image. When using such a printing process, it is normally necessary, after each printing operation for producing a partial print image, for that partial print image to be dried before the next partial print image is applied or the object can be handled in some other fashion. Accordingly, such an apparatus as outlined above generally has a respective drying station arranged downstream of each printing station in the direction of transportation movement of the objects through the apparatus, for drying the printing ink applied in the printing station upstream of each such drying station.

When using UV radiating devices in the drying stations, precautions possibly have to be taken to screen the area around the individual drying stations from the UV radiation.

It will be seen that a printing machine of the general structural configuration referred to above will usually require a considerable amount of space as multi-color printing is implemented by means of a machine comprising three, five or more printing stations and thus a corresponding number of drying stations. It will be appreciated that this requires a conveyor path of corresponding length which thus makes the machine very long when the path is a linear path or, when the machine is of a turntable kind involving a circular conveyor path along which the object holders are displaced, the arrangement will be of a correspondingly large diameter. Not only is the amount of space required very great but transportation and servicing of the machine are also made more difficult.

SUMMARY OF THE INVENTION

An object of the present invention is to provide an apparatus for decorating stiff objects which is so designed that for a given length of the object conveyor path there is a possibility of providing more treatment stations such as printing and drying stations, or, with a given number of such treatment stations the object conveyor path can be shorter.

A further object of the invention is to provide an apparatus for decorating stiff objects with a plurality of printing stations and respective downstream-disposed drying stations, which can be of a compact configuration having regard to the total number of treatment stations involved.

Yet another object of the present invention is to provide an apparatus for decorating stiff objects which is designed to provide for a quick and rational movement of objects from a printing station to the respective following drying station.

In accordance with the principles of the present invention the foregoing and other objects are attained by an apparatus for decorating stiff objects comprising an arcuate conveyor path, and holders transportable along the conveyor path for displacing objects to be decorated therealong. A plurality of treatment stations for treating the objects are disposed along the conveyor path, including at least one printing station for decorating the objects and at least one drying station arranged downstream of the printing station in the direction of transportation movement of the objects, to dry printing ink applied to the objects. The at least one drying station is at a spacing below the level at which the at least one printing station upstream thereof is disposed. The apparatus further has means for moving the holders upwardly and downwardly between a treatment procedure in a printing station and a treatment procedure in the respective following drying station and between a treatment procedure in a drying station and a treatment procedure in the respectively following printing station. The objects are printed upon from above and dried from below.

As will be seen from the description hereinafter of preferred embodiments of the invention, printing stations can be arranged above the conveyor path or form an upper boundary thereof and drying stations can be arranged below the conveyor path or form a lower boundary thereof. Thus, as considered in the direction of conveyor movement of the objects, the spacing between two successive printing stations can be markedly reduced, with the holders, after a printing operation has been carried out, being movable downwardly in order in that way to compensate for the difference in height between the level at which the printing procedure takes place and the level at which drying is effected. In that respect, possibly at the same time, rotational movement of the object about its longitudinal axis or an axis parallel thereto can be effected when the object is being printed upon at the top side but dried at the underside. That applies at any event in relation to objects which for example are of an elliptical or like cross-section.

After the drying operation has been effected, when the operating procedure to be carried out in the apparatus requires the application of further printing to the object in question, the object can be moved upwardly. If necessary, once again the object can be rotated in order to move it into the appropriate position for the following printing operation. Those upward and downward movements which are possibly necessary and also the rotational movements can be effected at least in part during the forward movement of the object along the conveyor path from one station to another so that the movements are implemented in mutually superposed relationship.

The devices required for producing the vertical movement components do not represent an additional requirement at any event if the apparatus is also used for printing on elliptical objects or other objects of an irregular shape, and the plane in which the printing operation is effected does not experience a change in its position in respect of height, as then, during that printing operation, the object must in any case perform a vertical movement which leads to vertical displacement of its longitudinal axis.

As, in the design configuration according to the invention, the drying stations are arranged below the level of the printing stations, the spacing between two adjacent printing stations needs to correspond substantially only to the cross-sectional dimensions of the objects and the holders carrying same. It is thus possible to make a quite considerable space saving which permits a substantially shorter conveyor path or, when the conveyor path is of a given length, allows a larger number of treatment stations to be disposed thereal-ong. It is optionally possible for the conveyor path portions between the stations to be smaller.

In accordance with a preferred feature of the invention the upward and downward movements of the object-carrying holders can be achieved in a simple manner by the provision of a common, vertically reciprocatable guide element being associated with a plurality of holders, to which guide element the holders are connected, for example by way of respective cam rollers, with the respective heightwise positions of the holders being set by suitable vertical adjustment of the respective guide element.

In accordance with a further preferred feature of the invention, when using UV radiation for drying the printing inks on the printed object, the regions containing the printing stations on the one hand and the regions containing the drying stations on the other hand are screened relative to each other. That can be effected by flat sight screens but also by screening elements which are disposed between the holders for carrying the objects and which are movable therewith.

Further objects, features and advantages of the invention will be apparent from the description hereinafter of preferred embodiments thereof.

DESCRIPTION OF PREFERRED EMBODIMENTS

Figure 1:
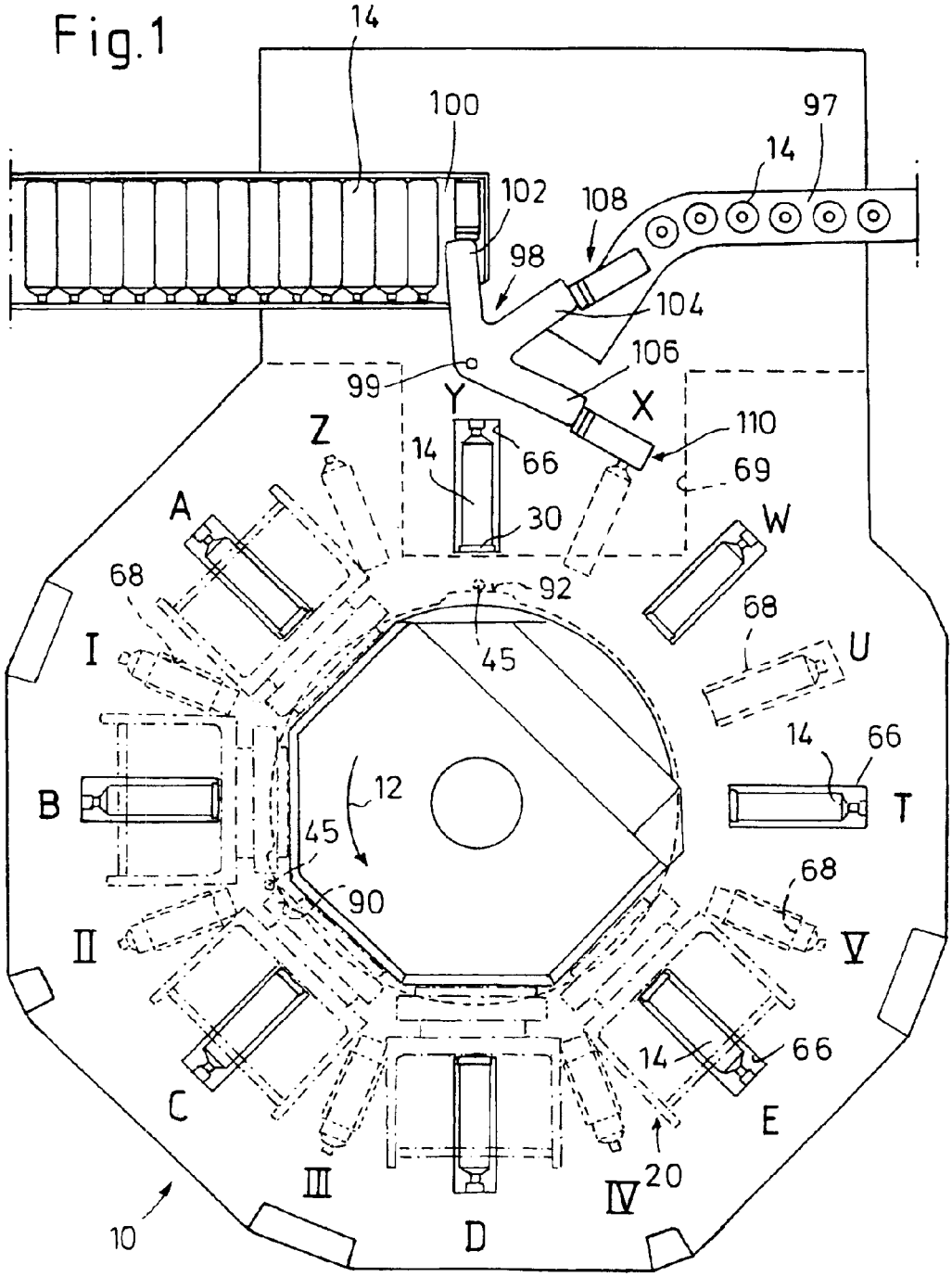
FIG. 1 is a plan view of an apparatus according to the invention for printing objects in the form of bottles, parts of the apparatus which are not directly related to the invention being omitted for the sake of enhanced clarity of the drawing.

It will first be noted that the embodiments of an apparatus according to the invention as are shown in the drawing are in the form of round apparatuses, that is to say the transport path along which holders for carrying objects to be displaced is of a circular configuration. The illustrated embodiments are provided with treatment stations consisting of five printing stations A–E in the form of screen printing stations and five drying stations I–V in the form of UV drying stations. The drying stations I–V are each arranged downstream of a respective one of the printing stations A–E in the direction of rotation indicated by arrow 12 of the turntable-like arrangement 10. The objects to which decorative printing is to be applied in this case involve bottles 14 carried by respective holders 16. The holders 16 are advanced about a vertical axis stepwise along a circular conveyor path as indicated at 18 for example in FIG. 2. The spacing between one of the printing stations A–E and the respective drying station I–V arranged downstream thereof in the direction of conveying movement of the objects is so selected that it corresponds to a conveyor stepping movement along the conveyor path 18.

Figure 2:
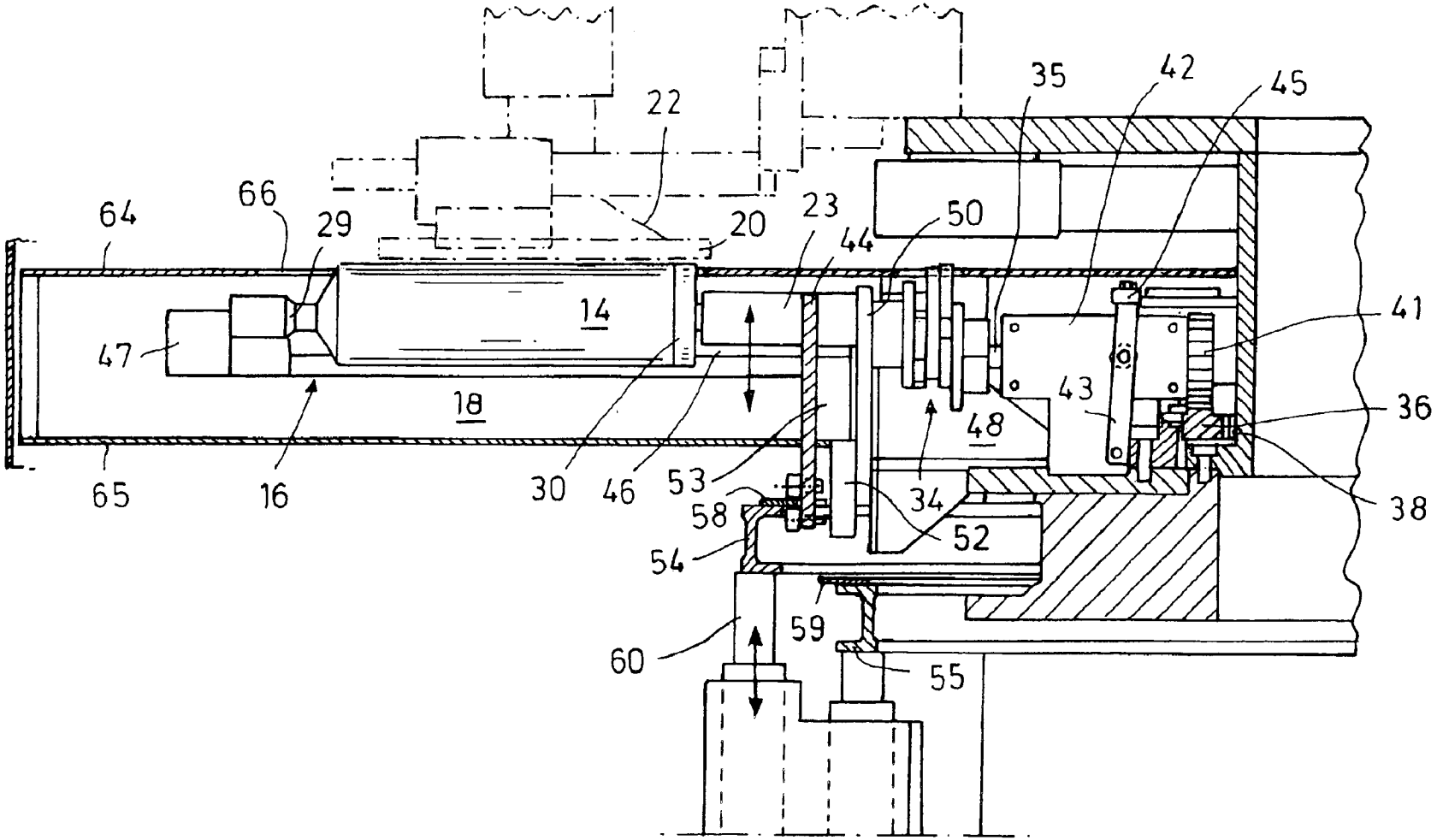
FIG. 2 is a partially sectional side view of a portion of the apparatus of FIG. 1 transversely with respect to the longitudinal axis of an object in a printing station.

Provided in each of the printing stations A–E is a screen printing stencil 20 which extends substantially in a horizontal plane and which co-operates with a doctor as indicated at 22 in for example FIG. 2. Each of the drying stations I–V is provided with at least one UV radiating device indicated for example at 24 in FIG. 5 which is arranged below the conveyor path 18 in such a way that the UV rays are directed substantially upwardly on to the respective object 14 which is disposed thereabove and whose lower region faces towards the UV radiating device 24 in the respective drying station.

Referring still generally to the drawing the embodiments illustrated therein by way of example of the invention are each provided with an annular table 26 which is movable stepwise about a vertical axis in the direction of the arrow 12 in FIG. 1. The object holders 16 are mounted to the table 26 in such a way that the respective object 14 carried by a holder 16 extends substantially radially with respect to the axis of rotation of the table 26. Each holder 16, in the manner which is usual when dealing with articles in bottle shape, has a centering point indicated at 29 for example in FIGS. 2 and 3, engaging into a respective bottle neck 28, and a receiving means indicated at 30 in for example FIGS. 2 and 3 for receiving the bottom of the bottle 14, the receiving means 30 being carried by a shaft portion indicated at 32 in FIG. 3 which is held rotatably within a cylindrical mounting portion 33. The parts of the holder 16, which support the objects, can however also be of a different configuration in dependence on the configuration of the objects which, as will be appreciated, do not need to be bottles. At the end remote from the object 14, the shaft portion 32 is connected to a compensating coupling indicated at 34 in FIG. 2 for example which is arranged in the drive train for the rotational or pivotal movement of the object 14 carried by the respective holder 16, and compensates for displacement as between the shaft portion 32 and a further shaft portion 35.

Figure 3:
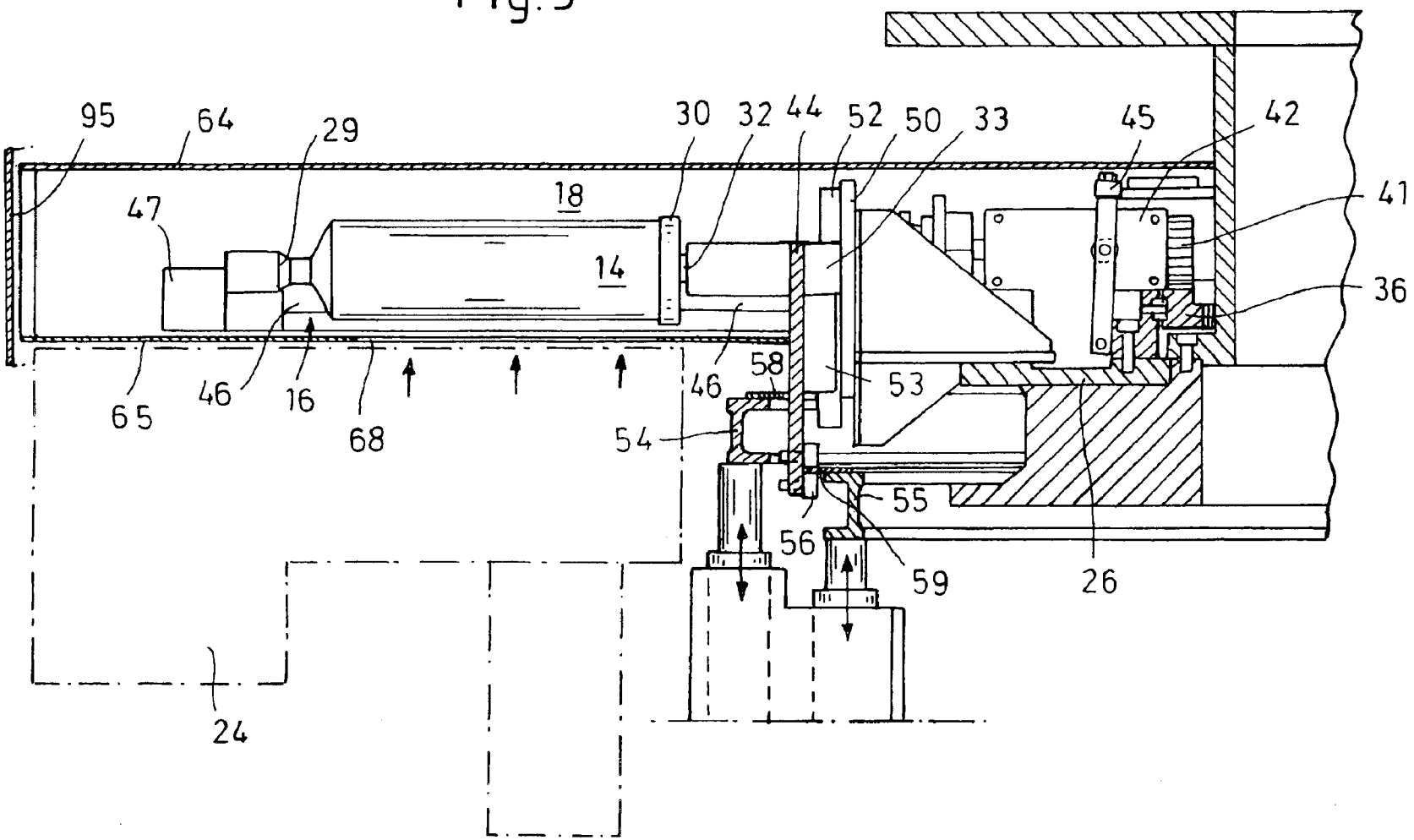
FIG. 3 is a partially sectioned side view corresponding to FIG. 2 transversely with respect to the longitudinal axis of an object in a drying station.
Figure 4:
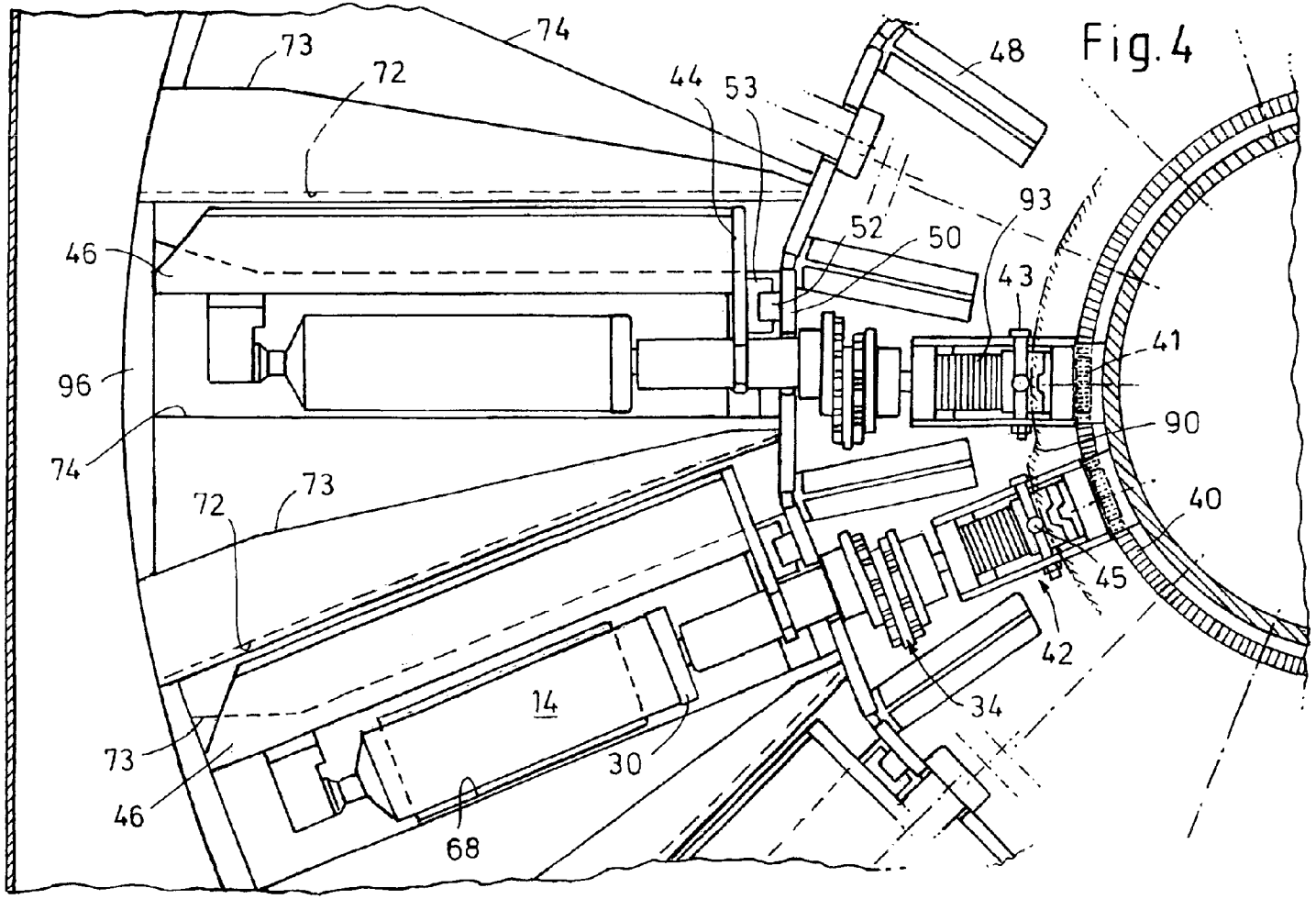
FIG. 4 is a plan view of a portion from a first embodiment in the region of the treatment stations, with the upper screening plate being omitted.

Referring now more specifically to FIGS. 2 through 4 the rotational or pivotal movements of the objects 14 carried by the holders 16 are produced by a common crown wheel 36 which is rotatable independently of the table 26 but coaxially with respect thereto, in both directions. At its inside the crown wheel 36 is provided with a peripherally extending tooth arrangement 38 which is in engagement with a drive pinion (not shown) driven by a program-controlled motor. At its top face the crown wheel 36 is provided with a tooth arrangement indicated at 40 in FIG. 4, with which a gear 41 of each holder 16 is in engagement. The gear 41 drives the shaft portion 32 carrying the receiving means 30 for the object 14, by way of a shift clutch 42 and the above-mentioned shaft portion 35 and by way of the compensating coupling 34. The mounting portion 33 which carries the shaft 32 is carried at its end remote from the receiving means 30 by the shaft portion 35 by way of the shaft compensating coupling 34. The clutch 42 is provided with an actuating lever 43 carrying a cam roller 45 co-operable with stationary cam portions 90, 92 mounted to the machine frame.

In addition the mounting portion 33 is connected between the compensating coupling 34 and the receiving means 30 to a transverse member 44 to which is fixed a carrier 46 which extends substantially parallel to the longitudinal axis of the object 14 and which near its free end carries the centering point 29, with the interposition of an adjusting device 47. The adjusting device 47 permits displacement of the centering point 29 in the direction of the longitudinal axis of the object 14 in order to clamp it in or release it from the holder 16. Those arrangements are familiar in the art so that there is no need for a more detailed description of either their specific design configuration or the mode of operation thereof.

Figure 5:
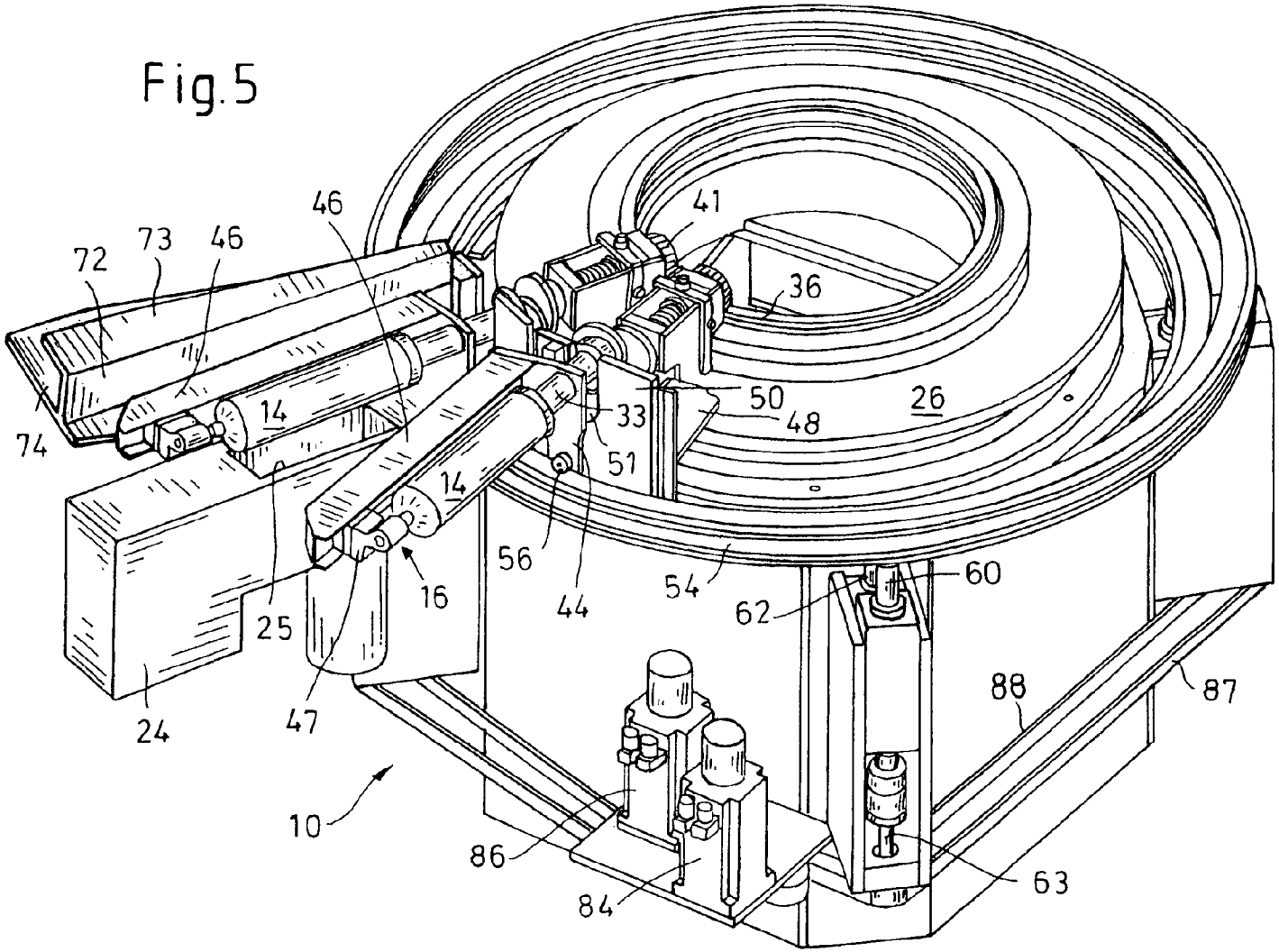
FIG. 5 is a perspective view of the first embodiment showing approximately the region of FIG. 4 and illustrating the basic structure of the machine.

Referring now also to FIG. 5, fixed to the table 26 between each two adjacent holders 16 is a respective substantially radially extending profile portion 48 which projects outwardly with respect to the table 26. Each two adjacent profile portions 48 carry a respective intermediate element 50 which extends substantially parallel to a tangent to the periphery of the table 26 and which on its top side is provided with a cut-out 51, the dimensions of which are somewhat larger than the cross-sectional dimensions of the mounting portion 33 which is accommodated by that cut-out 51. At the side of the intermediate element 50, which is towards the carrier 46, the intermediate element 50 is provided with a vertical guide bar 52 as is clearly shown for example in FIG. 2 co-operable with a U-shaped guide shoe indicated at 53 in FIG. 2, which embraces the guide bar 52 with a close fit so that, between the two members 52 and 53, there is a positively locking engagement which only permits vertical movements of the holder 16.

Looking now at FIGS. 2 and 3, the illustrated embodiment is provided with two stroke-producing rings 54 and 55 which are arranged movably upwardly and downwardly in coaxial relationship with the axis of rotation of the table 26. The rings 54 and 55 serve to guide cam rollers which are mounted to the holders 16 for the objects 14. The holders 16 are subdivided into two groups in such a way that holders 16 which are disposed in succession in the conveyor direction 12 belong alternately to one group or the other, and all the holders of a group are associated with a respective one of the two rings 54 and 55 respectively. To form a connection between each holder 16 and the respectively associated ring 54 and 55, the transverse member 44 of each holder 16 is provided with two cam rollers which are indicated at 56 in FIG. 3 and which are arranged in vertically superposed relationship with a spacing therebetween which corresponds to the thickness of a projection indicated at 58 and 59 respectively in for example FIG. 3, for example in the form of a sheet metal strip, which is mounted to the respective ring 54 and 55 for example by means of welding and which projects in a horizontal plane with respect to the respectively associated ring 54, 55 so that the pair of cam rollers 56 of each holder is in engagement with the respective strip 58, 59 in dependence on the group with which the respective holder 16 is associated, as can be clearly seen from FIGS. 2 and 3. The two sheet metal strips 58, 59, similarly to the two rings 54, 55, are in the form of a closed ring extending substantially in a horizontal plane.

Referring now to FIGS. 2, 3 and 5, it can be seen therefrom that each of the two rings 54, 55 is carried by four vertically displaceable stroke-producing spindles 60 and 62 respectively which are respectively arranged displaced with respect to each other through 90°. Associated with the spindles 60 and 62 of each ring 54 and 55 respectively is a common servo motor 84 and 86 as can be clearly seen from FIG. 5 as a drive means which is controlled in dependence on a suitable program for vertically displacing each ring 54, 55 and the holders 16 respectively connected thereto. The drive for the four spindles 60 and 62 of each ring 54, 55 is implemented by way of a respective toothed belt as indicated at 87 and 88 in FIG. 5. Each belt is in engagement on the one hand with a toothed belt pulley (not shown) arranged on the output shaft of the respective servo motor 84, 86 and on the other hand with toothed belt pulleys which drive the respective spindles 60 and 62 with the interposition of ball-bearing rolling spindles 63.

Looking at FIGS. 2 and 3, in the region surrounding the table 26, the apparatus is further provided with two flat, substantially horizontal screening plates 64 and 65 which respectively delimit the conveyor path 18 at the top and bottom thereof so that the holders 16 extend into the space between the two screening plates 64 and 65. The screen printing stations A–E with the screen printing stencils 20 are arranged above the upper screening plate 64. Directing attention to FIG. 1 showing a plan view in the plane of the upper screening plate 64, it will be seen that in the region at any event of the screen printing stations A–E, the upper screening plate 64 is provided with a respective rectangular cut-out 66 which is matched to the size and the configuration of the respective object 14 to be printed, in such a way that the object 14 is accessible from above, that is to say from the respective screen printing station disposed thereabove. The cut-outs 66 extend substantially radially with respect to the vertical axis of rotation of the table 26, in a manner corresponding to the arrangement of the respective holder 16 and corresponding to the respective object 14 carried thereby.

Arranged directly below the lower screening plate 65 are the devices of the drying stations I–V which essentially involve UV lamps 24, as can be seen from FIG. 3. They are provided at the top side with an opening indicated at 25 in FIG. 5 through which the UV rays from the lamps 24 are directed at least predominantly in a direction on to the respective objects 14 to be found thereabove. In this case the lower screening plate 65 is also provided above the through opening for the UV rays in the housing of the UV lamp with a respective radial cut-out 68 which is matched to the configuration and size of the objects 14 or the area to which printing is to be applied thereon, in order in that way to make the respective object 14 positioned in the respective drying station accessible to the UV rays. The cut-outs 66 and 68 are thus arranged in mutually displaced relationship by a distance corresponding to one conveying step in the conveying movement of the objects 14 through the apparatus.

In the region of stations indicated at Y and X in FIG. 1, in which the objects to be processed in the machine are introduced into the machine and removed therefrom respectively, the lower screening plate 65 has an edge cut-out indicated at 69 in FIG. 1 in order in that way to simplify accessibility in particular to the respective object in the removal station X, and also to simplify handling thereof. As in the region of the introduction station Y and the removal station X which are both close together and in the directly adjoining regions, the apparatus does not have any UV lamps, the absence of the lower screening plate 65 in that region 69 does not cause any problems.

The conveyor system comprising all of the holders 16 is provided in the region of the conveyor path 18 with additional screening elements 70 which are each formed by a profile portion. Such a screening element is arranged between each two holders 16 which follow in succession in the longitudinal direction of the conveyor path 18, as will be seen in particular from FIGS. 7A–7E which will be described in further detail hereinafter.

In this embodiment of the apparatus the approximately radially extending screening elements 70 are of an asymmetrical configuration at least in cross-section in such a way that an upper flange indicated at 73 in for example FIGS. 4 and 5 extends only towards one side from a web portion 72 whereas a lower flange 74 extends on both sides of the web portion 72, even if asymmetrically. The web portion 72 extends parallel to that holder 16 which is closest to the web portion 72 of the respective screening element 70. The latter is so arranged between the two screening plates 64 and 65 that the web portion 72 of the respective profile portion 70 extends vertically, that is to say perpendicularly to the two screening plates 64, 65, and one of the two flanges 73 and 74 bears with its outside surface against the upper screening plate 64 and the lower screening plate 65 respectively, so that, in the transportation movement of the holders, the screening elements 70 slide jointly with the holders 16 in the direction indicated by the arrow 12 in FIG. 1 along one of the two screening plates 64 and 65, preferably against the lower screening plate 65, in contact therewith.

It is desirable to provide a small spacing of for example 1–2 mm between the respective other screening plate and the screening element 70 or the respective flange thereof, so that there is no need for a precise fit between the two screening plates 64, 65 and the screening elements 70. With that small spacing, there is no risk of UV rays being able to pass through between the screening plates 64, 65 on the one hand and the screening elements 70 on the other hand.

It will be seen from the drawing, for example FIG. 5, that the screening elements 70 are of a width which increases from the inside outwardly. At their ends towards the vertical axis of rotation of the table 26, they are each fixed to the intermediate elements 50 of two adjacent holders 16, for example by means of welding. For that purpose the inward ends of the screening elements 70 are of a somewhat bevelled configuration to correspond to the configuration of the two adjacent intermediate elements 50. At their outward ends two adjacent screening elements 70 are connected together by a respective connecting element indicated at 96 for example in FIG. 4.

Reference will now be made to FIGS. 7A–7E which show a second embodiment in respect more specifically of the configuration of the screening elements 70. These Figures show the operating procedure involved in the treatment operations to which the objects 14 are subjected, as well as the conveying movement thereof along the conveyor path 18. FIGS. 7A–7E show the portion of the conveyor path 18 which includes the stations Z, A, I, B, II, C and III, the objects 14 to be treated however being shown in the form of bottles of substantially elliptical cross-section provided with a print image on both sides. The holders 16 are not shown in FIGS. 7A–7E for the sake of clarity of the drawing. It will be appreciated however that, in the structure shown in FIGS. 7A–7E, the fit afforded by the receiving means 30 for the bottom region of each bottle must be suitably matched thereto and consequently must also be of a substantially elliptical cross-sectional shape.

Figure 7A:
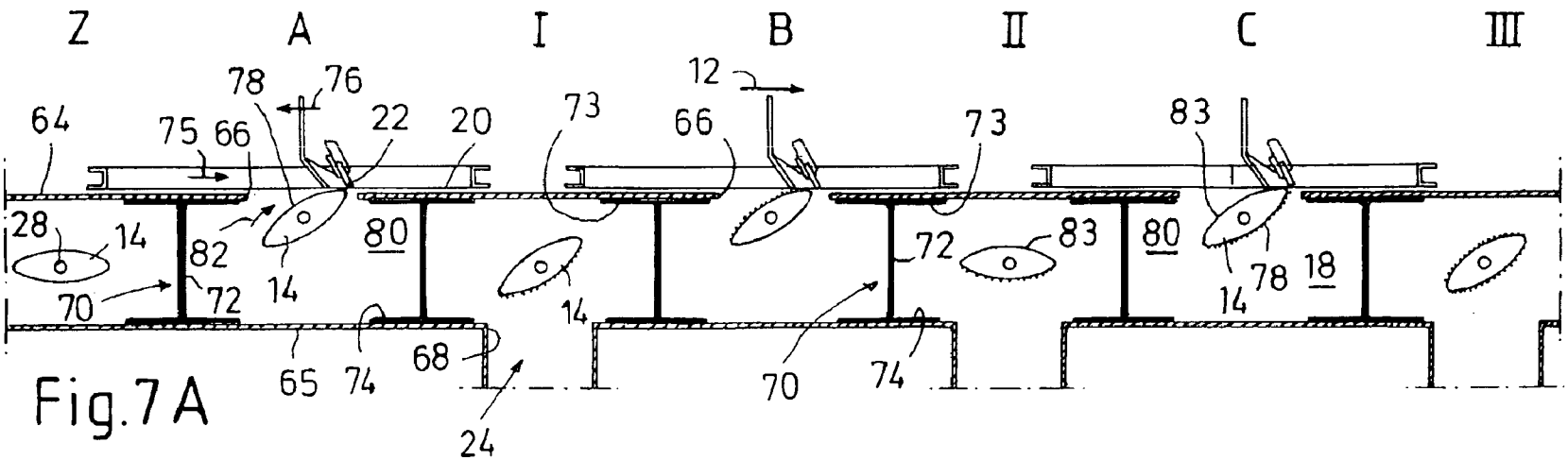
FIGS. 7A–7E show highly diagrammatic end views of a portion of the conveyor path of a second embodiment with a plurality of treatment stations, with the components being shown in different positions to demonstrate the procedure involved in an operating cycle.
Figure 7B:
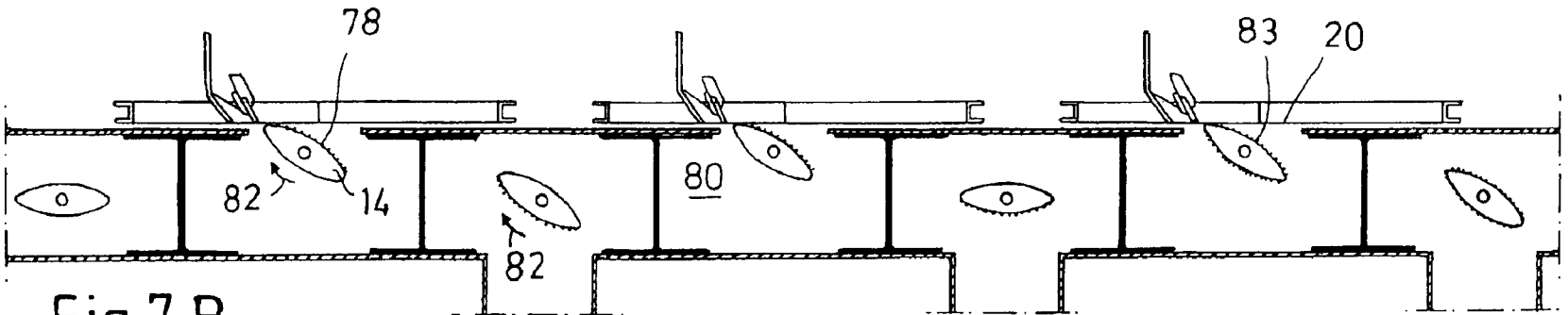
Figure 7C:
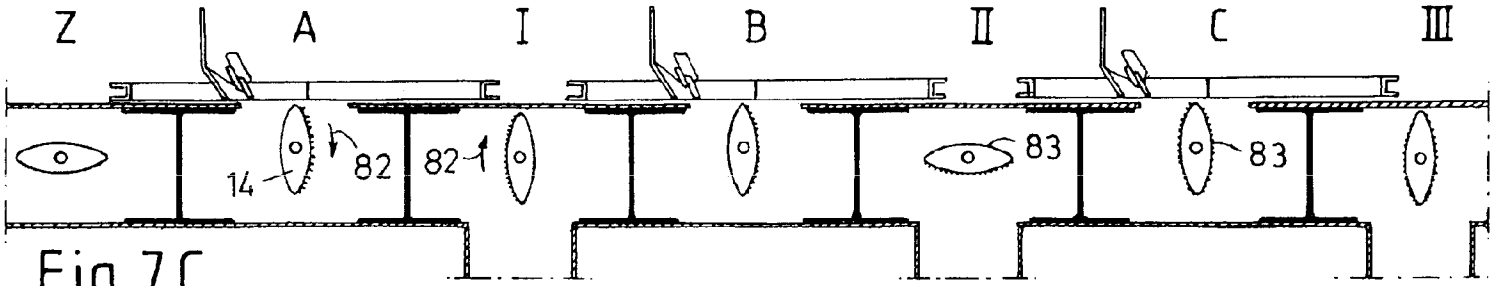
Figure 7D:
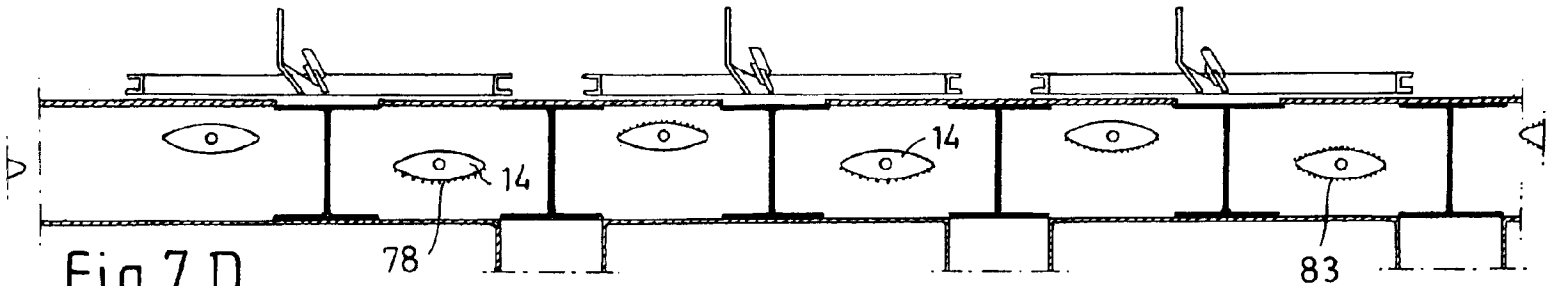
Figure 7E:
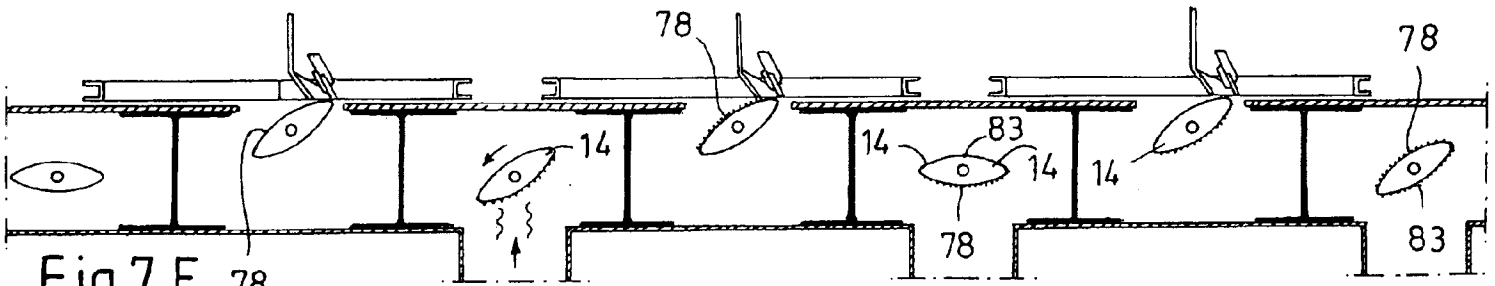

As will be seen from FIGS. 7A–7E the screening elements 70 are in the form of complete I-shaped profiles having flanges 73 and 74 which are substantially identical. The views in FIGS. 7A–7C and 7E show the condition between two steps in the conveying movement of the table 26 so that the holders 16 with the bottles 14 are each disposed in a respective one of the stations along the conveyor path 18. In the printing stations, at the beginning of a printing operation, the objects assume a position as shown in FIGS. 7A and 7E. In the course of the printing operation the objects are pivoted about their longitudinal axis in such a way that, at the end of the printing procedure, they respectively assume the position shown in FIG. 7B. During the printing operation the screen printing stencils 20 are displaced from the position shown in FIG. 7A in the direction of the arrow 75 into the position shown in FIG. 7B. At the same time the associated printing doctors 22 are displaced from the position shown in FIG. 7A into the position of FIG. 7B. During the printing operation the respective screen printing stencil 20 is displaced by the associated doctor 22 towards the surface 78 to which the printing is to be applied, with slight deformation of the stencil. At the end of the printing operation corresponding to the position of the components as shown in FIG. 7B the doctor 22 is lifted somewhat so that the screen comes out of contact with the surface 78. In other respects the stencil and the doctor are not displaceable in respect of height during the printing operation.

The movement of the printing doctor 22 during the printing operation in the direction indicated by the arrow 76 in FIG. 7A arises out of the fact that, during the printing operation, the object 14 is pivoted about its longitudinal axis and not about the axis of the curvature of the surface 78 to which printing is to be applied. These and other details relating to printing procedure are generally known in the art so that they do not need to be described in fuller detail here.

Figure 6:
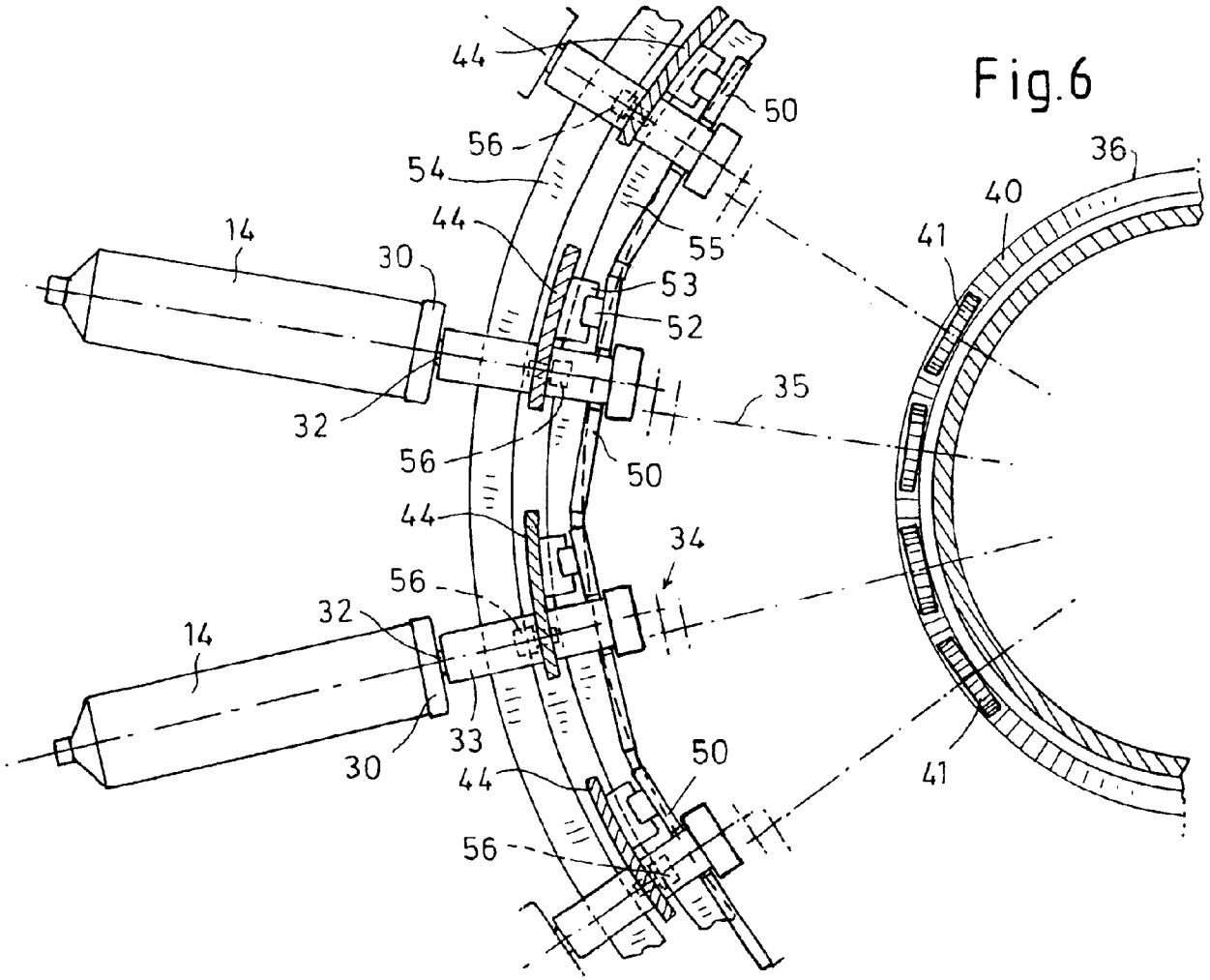
FIG. 6 is a view corresponding to FIG. 4, with parts being omitted for the sake of enhanced clarity of the drawing.

The pivotal movement of the object 14 from the position of FIG. 7A into that shown in FIG. 7B is produced by a suitable rotational movement of the crown wheel 36 which acts on the gear 41 of the respective holder 16 carrying an object 14 in a printing station A. The rotational movement of the gear 41 is transmitted to the receiving means 30 in which an object 14 is inserted, in the manner already described hereinbefore by way of the compensating coupling 34 which is generally in the form of a Schmidt coupling for compensating for shaft offset, or any other suitable form of coupling designed to allow shaft misalignment. FIGS. 4 and 6 in particular show that the shaft portion 32 carrying the receiving means 30 is arranged displaced somewhat in a horizontal plane with respect to the shaft portion 35 extending between the gear 41 and the coupling 34, so that the holder 16 and therewith the object 14 do not extend precisely radially with respect to the vertical axis of rotation of the table 26. That horizontal parallel displacement of the two shaft portions 32 and 35 is conditioned by the construction of the coupling 34 in the form of a Schmidt coupling and is of no significance in terms of the function of the apparatus.

The displacement as between the shaft portions 32 and 35, which is to be compensated by the coupling 34, is present in vertical directions. During a printing operation, the rotational movement of the elliptical object 14 about its longitudinal axis means that there is a variation in the heightwise position of the object 14 in such a way that, during the first half of the printing operation starting from the position shown in FIG. 7A until a position of the doctor 22 vertically above the longitudinal axis of the object 14 is reached, the longitudinal axis of the object is displaced in the sense of moving that longitudinal axis towards the stencil 20 and thereafter, during the second part of the printing operation, until the position shown in FIG. 7B is reached, the longitudinal axis of the object 14 is displaced in the sense of moving the longitudinal axis of the object 14 away from the stencil 20, by virtue of corresponding upward and downward movement respectively of the respective ring 54, 55. Those two vertical displacements which take place in dependence on the simultaneously implemented pivotal movement of the object 14 in the direction indicated by the arrow 82 for example in FIG. 7A are compensated by the compensating coupling 34, with the holder 16 being guided by the two vertically extending guide means 52 and 53.

During the printing operation the object 14 which is carried by the holder 16 is so arranged that at least the part, which is acted upon by the doctor 22, of the surface 78 or 83 to which printing is to be applied, projects slightly upwardly with respect to the upper screening plate 64, that is to say it protrudes slightly upwardly out of the cut-out 66, in order thus to permit satisfactory contact to occur between the surface 78 or 83 on the one hand and the screen printing stencil 20 on the other hand which, apart from the slight stretching effect under the action of the doctor 22 applying a downward force thereto, is not displaced vertically during the printing operation.

While the printing operations are taking place in the printing stations, an object 14 is being dried in a respective following drying station. Thus, the object 14 being dried in a given drying station is one to which printing had been applied in the preceding operating cycle, in the respectively preceding printing station. As the UV radiating devices 24 disposed in the respective drying stations I–V are each disposed beneath the conveyor path 18, they act on the downwardly facing side of the object 14 in the respective drying station so that, at any event when treating objects of elliptical or similar cross-section, the object is turned substantially through 180° after the printing operation so that the surface 78 or 83 which had been facing upwardly during the printing operation in the printing station now faces downwardly and is thus made available to the UV effect from the UV radiating devices 24. That pivotal movement of the previously printed objects is effected starting from the position shown in FIG. 7B, again in the direction indicated by the arrow 82, by way of the intermediate position of FIG. 7C into the position shown in FIG. 7D in which the surface 78 is facing downwardly, in which case at the same time a downward movement of the holders 16 with the respective object 14 carried thereby is implemented by suitable vertical displacement of the respective stroke-producing ring 53 or 54 with which the respective holders 16 are associated. The above-described movements, that is to say the pivotal movement in the direction of the arrow 82 and the at least partially simultaneous downward movement can be superimposed with the conveyor stepping movement of the table 26, which the entire arrangement implements in the direction of the arrow 12 along the conveyor path 18, so that, at the end of that conveying stepping movement, the parts assume the positions shown in FIG. 7E, which correspond to the positions of FIG. 7A.

The printing ink applied to the respective object 14 in the preceding treatment step in the printing stations is now dried in the respective following station. In that case, the objects perform a pivotal movement which is also implemented simultaneously by the objects 14 in the printing stations, during the printing operation, the holders thereof being connected to the crown wheel 36 by way of the clutches 42.

Reference will be made at this juncture to FIGS. 1 and 7 showing that, in the drying stations, the upper screening plate 64 is continuous, that is to say uninterrupted, so that no UV rays can issue upwardly from the region of the conveyor path 18. In the peripheral direction, that is to say in the direction 12 of the conveying movement, the conveyor path 18 is subdivided by the screening elements 70 into portions indicated at 80 in FIGS. 7A and 7B, which are delimited by the two screening plates 64, 65 and the respective screening elements 70 disposed between the holders. The screening elements 70, more specifically the web portions 72 thereof, each extend in parallel relationship with the longitudinal axis of that holder 16 which in the direction 12 of conveying movement is arranged upstream of the respective screening element 70, as can be seen from FIGS. 4 and 5.

The screening plates 64 and 65 and the screening elements 70 screen the printing stations and also the rest of the surroundings in relation to the UV rays. Screening of the printing stations is particularly important for the reason that, if UV rays are allowed to act on the screen printing stencils in the printing stations, the printing ink used therein would very rapidly harden.

After drying of the printing ink applied to the object 14 in the station A, in the drying station I as indicated in FIG. 7E, the duration of which can be the same as that of the printing operation which takes place at the same time in the printing station or stations, the object 14 is pivoted similarly to the pivotal movement which takes place simultaneously in the printing station A after the termination of the printing operation, in the direction of the arrow 82, as indicated in FIG. 7C, in order once again to cause the side 78 to which printing has already been applied in the station A to face upwardly, that is to say, to make that side 78 accessible for the next printing operation in the station B, as is shown in FIGS. 7D and 7E. The only difference between the movements in the drying station I on the one hand and in the printing station A on the other hand is that, at least at the beginning of the pivotal movement, the object 14 is in a lower position than the object 14 which is in the printing station A.

At the same time, the next conveying stepping movement of the conveyor system comprising the holders 16 and the screening elements 70 also takes place in the direction of the arrow 12 so that the object 14 moves out of the station I into the following printing station B and is moved therein into the position for the commencement of the next printing operation. In the following treatment step, a further partial printing image is then applied to the partial printing image already applied in the station A, to the surface 78, the object assuming the position shown in FIG. 7B at the end of that treatment step in the printing station B.

Pivotal movement of the printed object then takes place, as shown in FIGS. 7C and 7D, in the manner already described above in connection with the transfer from the station A into the station B. In the following conveying stepping movement of the conveyor system that object is moved in the direction of the arrow 12 by way of the intermediate position shown in FIG. 7D into the position shown in FIG. 7E, in which the printed surface 78 faces downwardly and is thus towards the UV radiating de vice in the form of a lamp disposed at that location.

The object 14 which is now in the printing station II is to have further printing applied thereto, in the following printing station C and possibly in still further printing stations, on the surface 83 which is in opposite relationship to the surface 78 which has already been provided with two partial printing images, and thus, as the surface 78 faces downwardly, the surface 83 faces upwardly by virtue of the symmetrical, approximately elliptical configuration of the object 14. Thus the position assumed by the object 14 in the station II already satisfies the condition that the surface 83 to which printing is next to be applied is accessible from above. Thus, in contrast to the positioning operation subsequent to the drying step in station I, for the next printing operation in station B, there is no need for the object 14 to be pivoted again through 180°.

That would occur however if the holder carrying the object 14, or the receiving means 30 thereof, were to remain connected to the crown wheel 36. In order to prevent a pivotal movement of the object 14 between the station II and the following printing station C, the shift clutch 42 of the holder 16 in the station II is actuated in such a way that the connection between the gear 38 of that holder, which is in a condition of engagement with the crown wheel 36, and the receiving means 30, is interrupted. That takes place in the course of the conveying movement from the printing station B into the drying station II after the object 14 has reached the angular position shown in FIG. 7D, in which the surface 83 faces upwardly and the longer axis of the approximately elliptical cross-section of the object extends substantially horizontally.

For the purposes of actuation of the shift clutch 42 at the holders 16 the apparatus is provided with first and second cams indicated at 90 and 92 for example in FIG. 1 with the cam 90 also being shown in FIG. 4. The cam 90 is associated with a region in which the treatment stations are disposed and the cam 92 is associated with a region in which the stations X, Y and Z are arranged. In the course of the movement in the conveyor direction 12 the cam 90 or 92 respectively acts on the cam roller 45 of the respective holder 16, with the result that the associated actuating lever 43 is pivoted and the clutch 42 is disengaged. At least the cam 90 in the region of the treatment stations is arranged displaceably so that the position thereof can be adapted to the respective factors involved, that is to say it can be so selected that the respective clutch 42 is actuated in the respectively desired position of the associated holder. The consequence of disengagement of the clutch 42 is that the object 14 in the subsequent phases does not participate in the pivotal movements transmitted by virtue of the crown wheel 36 and it remains in its position as shown in FIG. 7E and 7A respectively.

During the following conveying stepping movement in the direction of the arrow 12, the clutch 42 is re-engaged when the object 14 is transported from the station II into the printing station C. That is produced by virtue of the fact that, in that region, the cam 90 is of a configuration which permits engagement of the clutch 42 under the force of a coil spring as indicated at 93 in FIG. 4, which had been compressed upon previous clutch disengagement. During that conveying stepping movement which is as shown in FIG. 7D, all objects 14 assume a position in which the major axis of the approximately elliptical cross-section of the object extends substantially horizontally. As soon as the clutch 42 is engaged, the respective holder 16 again moves synchronously, in respect of its movements implemented by the crown wheel 36, with the other holders which are operatively connected to the crown wheel 36 by way of the respective clutches 42. In the view shown in FIGS. 7A through 7E, this involves the stations A, I, B, C and III.

After the conclusion of the printing operation in station C the object is then pivoted again in the manner described hereinbefore with reference to FIGS. 7A through 7D, in such a way that the surface 83 which is now also provided with a printed image or a partial printed image faces downwardly and thus, after reaching the drying position in station III, is accessible from below for the rays emanating from the UV radiating device disposed at that location. Further treatment of the object 14 depends for example on whether at least one further partial printed image is applied on the surface 83. That would then involve for example the operating movements which are illustrated in FIGS. 7A–7D in regard to the transfer from the drying station I into the printing station B, as described hereinbefore.

By virtue of the common drive by means of the crown wheel 36, the objects 14 in the respective drying stations I and III are pivoted about their respective longitudinal axis synchronously with the objects in the respective printing stations. In contrast, the respective object in the drying station II does not participate in those pivotal movements since, as explained hereinbefore, the shift clutch 42 of the respective holder which is in the station II is in a disengaged condition. However that consideration, that is to say the absence of the pivotal movements, does not adversely affect the drying operation, especially as the downward movement, caused by the respective stroke-producing ring 54, 55, of the holder and therewith the object 14 from the position in the printing station into the position in the respectively following drying station can be so selected that the relative positioning of the object 14 and the UV radiating device 24 in any case affords adequate drying of the printing ink on the object 14.

It will be seen that the embodiments illustrated in the drawing are provided with sixteen holders 16 so that, as already indicated above, eight holders are associated in each case alternately with one of the two stroke-producing rings 54, 55. Thus, FIG. 1 and FIGS. 7A–7E show that those objects which are each in the respective stations A, B and C are associated with that ring 54 or 55 which is in a higher position, at the moment in time corresponding to the individual Figures. That also applies in regard to the objects 14 and the respectively associated holders 16 in the stations T, W and Y. In contrast, the position of the objects 14 disposed in the stations I through V, the removal station X and the stations U and Z is determined by the respective other one of the two rings 54 and 55 which in those stations causes the holders 16 and therewith the objects 14 to be in a lower position.

The extent of the vertical movement of the holders 16 and therewith the objects 14, between the level of a printing station and that of a drying station, depends also on the cross-sectional dimensions of the objects 14. Thus it is possible, for example when applying printing to objects whose cross-section in the region to be printed upon is cylindrical and relatively large, for the vertical movements to be reduced by suitable adjustment of the programs for controlling the movements of the rings 54 and 55, to a small distance which is sufficient to move the object in the printing stations below the level defined by the lower boundary of the screening plate 64 so that the respective object is not impeded by the screening plate 64 in terms of the conveying stepping movement into the respective next station. With the presumed large diameter of the object, the object in the drying station would be in any case disposed with its underside so close to the UV radiating device that satisfactory drying thereof would be guaranteed. That can be achieved by simply rotating the object 14 about its longitudinal axis, when printing is to be applied to the object all around same. When dealing with cylindrical or almost cylindrical objects, the transfers from the printing stations into the respective following drying station, as described hereinbefore with reference to FIGS. 7A–7E, would not be necessary as generally printing on two sides is not a situation which falls to be considered in relation to a cylindrical object.

When applying printing to an object which is of a cylindrical or similar shape, generally a simple rotary movement about the longitudinal axis of the object or about an axis parallel thereto will be sufficient to bring each desired region of the surface of the object into the operative region of the UV rays, in the respective drying station. In that respect, in dependence on the size of the diameter of the object, it may be desirable to provide for vertical displacements thereof in order to move the object closer to the UV radiating device in the form of a lamp for example in the drying station. In addition, when applying printing to objects of a cylindrical or similar shape, it may also be desirable or possibly even necessary for the connection between the holder 16 and the crown wheel 36 to be interrupted by suitable actuation of the respective shift clutch 42 in order for example to set the object in specific angular positions or simply to interrupt the rotary movement thereof.

The operating procedure described hereinbefore with reference to and as shown in FIGS. 7A–7E applies irrespective of the specific design configuration of the screening elements 70.

FIGS. 7A–7E show that, in the peripheral direction of the apparatus, when the conveyor system adopts its rest condition and the holders 16 with a respective object 14 are in the treatment stations, the screening elements 40 are arranged in such a way that the cut-outs 66 and 68 in the screening plates 64 and 65 respectively remain open, that is to say they are not covered over by the flanges 73 and 74 of the screening elements 70. Screening of the printing stations and in particular the screen printing stencils at the printing stations is implemented in particular by the web portions 72 of the screening elements 70, which vertically subdivide the conveyor path 18. In this respect, the flanges 73, 74 which bear against the screening plates 64, 65 or which are in the proximity thereof also guarantee an adequate screening effect to prevent the transmission of UV rays, between a respective screening element 70 and the screening plates 64, 65. The upward and downward screening effect is afforded by the two screening plates 64, 65 which are closed, apart from the cut-outs 66 in the upper plate 64 and the cut-outs 68 in the lower plate 65. That consideration applies in particular in regard to the region above the drying stations in order, as already mentioned, to protect the respectively adjacent printing station or stations from the action of UV rays thereon.

In the illustrated embodiments, the width of the flanges 73 and 74 of the screening elements 70 transversely with respect to the longitudinal dimension of the associated web portion 72 and also the length thereof are so selected that, during the conveying stepping movement, the screening elements 70 which advance in the conveying direction 12 completely close the cut-outs 66 and 68 respectively when they assume approximately the central position between two treatment stations, as is shown in FIG. 7D. The movements illustrated in FIGS. 7A–7E further show that, during the conveying stepping movement, the screening for the printing stations in relation to the UV rays from the drying stations is guaranteed at any event as portions 80 which are respectively delimited by two adjacent screening elements 70 always remain shut off relative to each other, wherein the flanges 73 and 74, while passing the cut-outs 66 and 68 respectively, also close each of them to such an extent that UV rays issuing from the cut-out 68 of a drying station cannot pass into a cut-out 66 of an adjacent printing station.

At the outward side the conveyor path 18, at least in the region of the respective drying stations, is delimited and screened by a suitable screening means such as a stationary metal sheet indicated at 95 for example in FIG. 3. At the inward side there is normally no need to provide a particular screening arrangement as the apparatus components disposed there in any case provide for a sufficient screening action in relation to UV rays.

Which configuration of the screening elements 70 is preferred in each case also depends inter alia on the configuration and size of the objects 14 and the extent of the movements which the objects and therewith the respective holder carrying same perform in the treatment stations. The structure shown in FIGS. 4 and 5 will normally be considered when the amount of space available for movement of the objects within the portion of the conveying path, which is defined by two adjacent screening elements 70, must be particularly large.

The upper screening plate 64 can be of a double-wall nature in such a way that it comprises two metal sheets which are arranged at a small spacing from each other of for example 1 mm and through which coolant such as cooling air can be passed. Whether that is necessary depends on the respective circumstances involved, in particular the number of UV lamps, the radiation duration, that is to say for example also whether the UV radiating devices are in operation uninterruptedly at full power or whether their power is reduced for example during the transport stepping movement, and also other circumstances such as for example the external temperature.

In the embodiments illustrated in the drawing the stations T, U and W arranged between the drying station V which is last in the conveying direction 12 and the object-removal station X can serve to check for example the quality of a print image applied to the objects. That can be effected by means of cameras or other suitable devices which detect the print image on the respective object, through the respective cut-out 66 or 68. The pivotal or rotational movement of the object produced by the action of the crown wheel 36 can be used to bring the entire print image into the recording region of the camera. Depending on the respective requirements involved however it is also possible for the station T to be provided as a further printing station and for the station U to be a further drying station so that it is also possible for example to apply a further print image or partial print image, possibly using a different color or ink, to the object.

In the removal station X the object will be in the lower position shown in FIG. 3 so that accordingly a removal device (not shown) which can be any suitable device such as a gripper for handling the object engages the object in that lower position and, after a pivotal movement through about 90°, places it with its bottom on a conveyor device indicated at 97 in FIG. 1 which then transports the printed objects such as bottles away for further use thereof.

In the introduction station Y the holders 16 are each in the upper position shown in FIG. 2 so that accordingly an introduction device 98 illustrated in FIG. 1 can also transfer the objects in that upper position to the respective holder 16 which is in the station Y. The introduction device 98 is provided with three arms in this illustrated embodiment, the arms being reciprocatable between first and second positions by a pivotal movement synchronously about a vertical axis indicated at 99. The first object or bottle on the conveyor means 100 feeding the objects to the introduction apparatus 98 is engaged by a first arm indicated at 102 of the introduction apparatus 98 and, in the subsequent rotary movement about the vertical axis 99, moved into an intermediate station indicated at 108 and there picked up by a holder (not shown). The introduction apparatus 98 is there-upon rotated back into the starting position shown in FIG. 1 so that the first arm 102 can pick up the following object or bottle which is carried on the conveyor means 100.

The second arm 104 of the introduction apparatus 98, in the starting position thereof as shown in FIG. 1, is in the intermediate station 108 in which the object deposited there in the preceding working operation is being subjected for example to a preparatory treatment. In the next rotary movement of the introduction apparatus 98 from the starting position of FIG. 1 into the second position thereof, the object or bottle in the intermediate station 108 is conveyed by the second arm 104 into a second intermediate station 110 in which the bottle is taken over by a further holder (also not shown). In the station 110 the object or bottle can be oriented for example in the peripheral direction if the printing is to be applied to the object or bottle in a given peripheral region thereof. In that pivotal movement of the introduction apparatus 98 from the starting position into the second position, at the same time the next object or bottle has been conveyed by the conveyor means 100 into the first intermediate station 108. After the two objects or bottles have been deposited in the respective intermediate stations 108 and 110 respectively the introduction apparatus 98 is rotated back into the starting position of FIG. 1 again so that the third arm 106 of the apparatus 98 passes into the intermediate station 110 and there picks up the object or bottle which has been subjected to intermediate treatment, for example suitably oriented, and then conveys it in the course of subsequent rotary movement of the apparatus 98 into the region of the holder 16 which is in the introduction station Y and there delivers the object or bottle to that holder.

In the course of the movement from the station W into the removal station X the respective holder 16 has been opened by suitable displacement of the centering tip 29 in the direction of the longitudinal axis of the object, that opening movement and the function of the removal gripper (not shown) being synchronised in such a way that the object is gripped by the removal gripper at the latest at the time at which the holder 16 is opened. The holder 16 which is now empty remains opened until it reaches the introduction station Y. It is closed as soon as an object 14 has been moved into the region of the holder 16 by the third arm 106 of the apparatus 98.

Displacement of the centering tip 29 can be produced for example by a stationary cam which acts by way of suitable means, for example a cam roller or the like, on the displaceably arranged centering tip 29. In that way, actuation of the centering tip 29 for opening and closing the respective holder can be derived from the conveying movement of the holder 16 in the direction of the arrow 12. As already indicated above, on passing through the stations X and Y the holders 16 are uncoupled from the drive produced by the crown wheel 36 in order in that way to facilitate introduction and removal of the objects into and out of the respective holders 16.

The objects or bottles which are fed to the station Y by the introduction apparatus 98 are introduced through the cut-out 66 in the upper screening plate 64, that is to say from above, into a respective holder 16 in the station Y. For that purpose the part of the third arm 106, which carries a respective object or bottle, is adapted to be movable upwardly and downwardly. The introduction apparatus 98 on the one hand and the removal apparatus on the other hand are arranged at a vertical spacing from each other so that the movements of the one item of equipment can be implemented independently of the movements of the respective other item of equipment.

It will be appreciated that the above-described embodiments of the apparatus according to the invention have been set forth solely by way of example and illustration of the principles thereof and that various other modifications and alterations may be made therein without thereby departing from the spirit and scope of the invention.

What is claimed is:

1. Apparatus for decorating stiff objects comprising an arcuate conveyor path, holders for carrying respective objects and movable along the conveyor path for displacing the objects therealong, means for conveying the holders along the conveyor path, a plurality of treatment stations for treating said objects disposed along the conveyor path, said treatment stations including at least one printing station for decorating the objects and at least one drying station arranged downstream of the printing station in the direction of conveying movement of the objects for drying printing ink applied to the objects, wherein the at least one drying station is at a level at a spacing below the level at which the at least one printing station is disposed, and motion means for moving the holders downwardly and upwardly between a treatment procedure in a printing station and a treatment procedure in the respectively following drying station and between a treatment procedure in a drying station and a treatment procedure in the respectively following printing station, wherein the objects are printed upon from above and dried from below.

2. Apparatus as set forth in claim 1 including control means for controlling said motion means to produce the upward and downward movement of the holders at least in part during a conveying stepping movement between two treatment procedures.

3. Apparatus as set forth in claim 1 including actuating means for producing movement of the holders upwardly and downwardly at least in the at least one printing station in dependence on the cross-sectional shape of an object to be printed during the printing operation.

4. Apparatus as set forth in claim 1 wherein at least one printing station is in the form of a screen printing station.

5. Apparatus as set forth in claim 1 wherein at least one drying station includes an UV radiating device.

6. Apparatus as set forth in claim 5 wherein the UV radiating device is below the position assumed by an object in the respective drying station.

7. Apparatus as set forth in claim 1 wherein a drying station is arranged downstream of each printing station in the direction of conveying movement of the objects.

8. Apparatus as set forth in claim 1 and further including means for driving the holders in rotation, whereby an object held by a respective holder is rotatable about the longitudinal axis of the object.

9. Apparatus as set forth in claim 8 and including a common rotary drive means for a plurality of said holders.

10. Apparatus as set forth in claim 9 wherein the rotary drive for each respective holder includes a drive train incorporating a controllable clutch for selectively connecting the holder to and disconnecting it from the common rotary drive.

11. Apparatus as set forth in claim 9 wherein the rotary drive for each holder includes a drive train incorporating a compensating coupling for compensating the differing heightwise positions of the holder portions carrying each respective object.

12. Apparatus as set forth in claim 1 wherein the holders are subdivided into first and second groups such that successive holders in the direction of conveying movement belong alternately to respective ones of the first and second groups and including means for joint vertical reciprocating movement of the holders of each of the first and second groups.

13. Apparatus as set forth in claim 12 including first and second guide cam means extending along the conveyor path, and means for producing vertical reciprocating movement of the first and second guide cams, the arrangement being such that the holders of one of said first and second groups are operatively related to the one guide cam and the holders of the respective other group are operatively related to the other guide cam.

14. Apparatus as set forth in claim 12 including means for alternately moving the first and second groups of holders upwardly and downwardly, wherein at least some of the holders of the first group are disposed in a respective printing station when at least some of the holders of the other group are disposed in a respective drying station.

15. Apparatus as set forth in claim 1 including means for screening at least the at least one printing station from view in relation to the at least one drying station.

16. Apparatus as set forth in claim 15 wherein the conveyor path at least in the region thereof which comprises the at least one drying station is delimited at top and bottom by a respective flat screening means and the at least one printing station on the one hand and the at least one drying station on the other hand are respectively arranged above and below the screening means, and said screening means are at least respectively provided in the region of a printing station and a drying station respectively with an opening and objects are respectively accessible from above in the printing stations and from below in the drying station through said openings and said openings in the printing station on the one hand and in the drying station on the other hand are displaced relative to each other in the direction of conveying movement of the objects.

17. Apparatus as set forth in claim 16 including a screening member between first and second adjacent holders, and means for moving the screening member stepwise along the conveyor path with the holders, wherein the height of the screening member at least approximately corresponds to the vertical spacing of the two screening means.

18. Apparatus as set forth in claim 17 wherein the screening member is in the form of a shaped portion having a web portion extending substantially vertically and approximately radially with respect to the center point of the conveyor path and at least one flange bearing against one of the stationary screening means.

* * * * *